United States Patent [19]

DeGraff

[11] 4,082,653

[45] Apr. 4, 1978

[54] CRUDE OIL DISTILLATION PROCESS

[76] Inventor: Richard Raymond DeGraff, 1505 E. Central Rd., Arlington Heights, Ill. 60005

[21] Appl. No.: 742,415

[22] Filed: Nov. 17, 1976

[51] Int. Cl.[2] ..... C10G 7/00; C10G 31/08; C10G 34/00

[52] U.S. Cl. ..... 208/251 R; 208/349; 208/352; 208/354; 208/365

[58] Field of Search ..... 208/251 R, 348, 352, 208/354, 365, 349

[56] References Cited

U.S. PATENT DOCUMENTS

| | | | |
|---|---|---|---|
| 2,338,595 | 1/1944 | Packie | 208/354 |
| 3,537,985 | 11/1970 | Mayhue | 208/352 |
| 3,888,760 | 6/1975 | Ebert | 208/251 R |

*Primary Examiner*—Herbert Levine
*Attorney, Agent, or Firm*—Glen P. Winton

[57] ABSTRACT

Heated hydrocarbon crude oil is passed into a first flash zone wherein it is separated into a first flash vapor and a first flash liquid. First flash vapor is water washed to remove soluble contaminants, and the resulting wash water and the first flash liquid are passed to a desalter. First flash liquid having substantial freedom from water soluble contaminants is passed from the desalter into a second flash zone wherein it is separated into a second flash vapor and a second flash liquid. The second flash liquid is passed into a conventional fractionation zone comprising a crude column and a vacuum column.

18 Claims, 2 Drawing Figures

Figure 1:
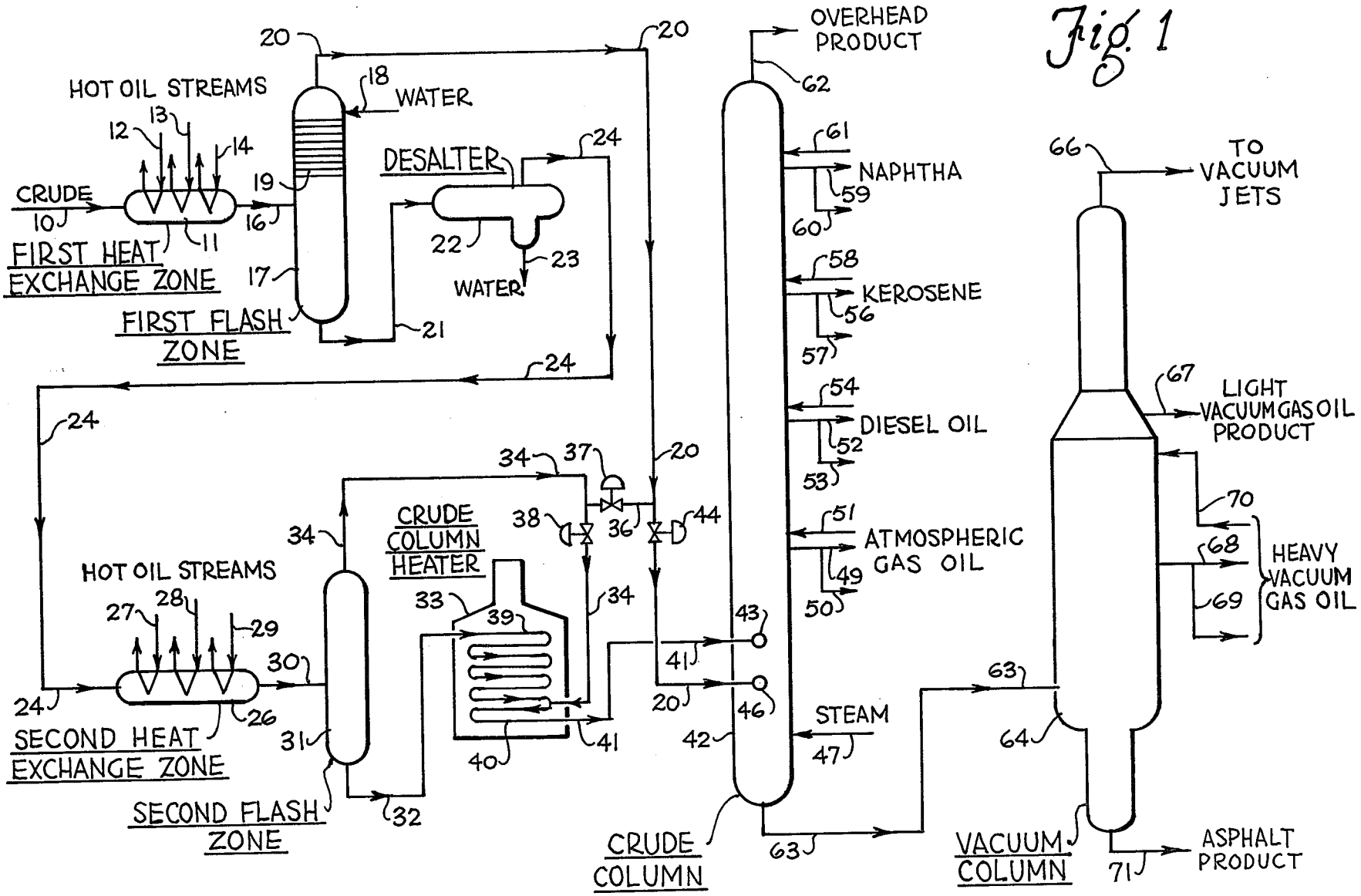

TO VACUUM JETS
LIGHT VACUUM GAS OIL PRODUCT
HEAVY VACUUM GAS OIL
ASPHALT PRODUCT
VACUUM COLUMN
OVERHEAD PRODUCT
NAPHTHA
KEROSENE
DIESEL OIL
ATMOSPHERIC GAS OIL
STEAM
CRUDE COLUMN
WATER
DESALTER
WATER
CRUDE COLUMN HEATER
HOT OIL STREAMS
CRUDE
FIRST HEAT EXCHANGE ZONE
FIRST FLASH ZONE
HOT OIL STREAMS
SECOND HEAT EXCHANGE ZONE
SECOND FLASH ZONE

DESALTER
FIRST FLASH ZONE
SECOND FLASH ZONE
CRUDE HEATER
BOTTOM SECTION CRUDE COLUMN
STEAM
REDUCED CRUDE
CRUDE
LC
200 PSIG STEAM GENERATOR
50 PSIG STEAM GENERATOR

CRUDE OIL DISTILLATION PROCESS

BACKGROUND OF THE INVENTION

The present invention relates to an improved distillation process for separating a hydrocarbon crude oil into its hydrocarbon product fractions.

The present invention further relates to an improved process for heat exchanging a crude oil with the hot circulating oil streams produced during the fractionation of the crude oil into its hydrocarbon product fractions.

In particular, the present invention relates to an improved process for separating a crude oil into its hydrocarbon product fractions utilizing a crude column and a vacuum column in combination with improved heat exchange and single or double stage flashing of the hot crude oil feed stock.

Those skilled in the art of hydrocarbon processing are familiar with the conventional manner in which a hydrocarbon crude oil is separated into its hydrocarbon fractions. Typically, the crude oil is heated in a series of heat exchangers wherein the crude oil picks up heat from circulating hot oil streams which are produced in a crude fractionating column and a vacuum column. The crude column fractionates the heated crude oil in the presence of stripping steam to produce a series of products of differing boiling range. The number of products produced in the crude column may range from two or three up to as many as eight, depending upon the type of crude oil being processed and the type of products which are desired by the refinery. Typically, the crude column will produce an atmospheric gas oil, a diesel oil, a kerosene, and a naphtha as side cut products. It will also produce a gasoline fraction as the overhead product and a reduced crude as the bottoms product. The reduced crude is sent to the vacuum column where it is separated into a light vacuum gas oil and a heavy vacuum gas oil as side cut products, and an asphalt fraction as the bottoms product.

Typically, the crude oil is brought up to the feed temperature required by the crude column by being passed through a series of hot oil heat exchangers and then being heated in a gas or oil fired heater. As an example, the crude oil will first be heated by a circulating naphtha stream which is produced by the crude column. Next the crude oil will be heated by the product kerosene which is leaving the crude column. It may be further heated by passing sequentially in exchange with the circulating kerosene stream and the diesel product stream. The hot crude oil may then be passed into a desalter which removes the salt and other water soluble contaminants from the hot crude. The desalted hot crude may be further heated by then picking up heat in another series of heat exchangers wherein the crude oil is sequentially heated by the circulating diesel oil stream, the atmospheric gas oil product stream, and the circulating atmospheric gas oil stream of the crude column. Next, the hot crude oil is sequentially heated in exchange with the circulating heavy gas oil stream and the asphalt product stream of the vacuum column. Finally, the hot crude oil is passed into the crude column heater wherein it picks up the final amount of required heat by means of convection and radiation produced through the combustion of gas or oil in the heater.

Since the heat exchange is conducted in series, a large pressure drop is experienced and it is typical for the discharge pressure of the crude oil pump to be from 125 to 200 psig. or even higher. This high crude oil pressure is a detriment to the crude oil fractionation process.

First of all, the high crude oil pressure causes the crude oil to be passed through the tubes of the heat exchanger bundles in the heat exchanger sequence since the crude oil is at a pressure which is higher than the pressure of the hot oil streams with which it is being heated. This is sound practice from an equipment design standpoint. The high pressure stream is put through the tubes since less steel is required in making the tube wall thickness of sufficient strength than would be required to make the heat exchanger shell thick enough to hold the same pressure. Thus, the heat exchanger costs are minimized. This is inefficient from a heat exchange point of view, however, since the cold crude oil should generally be put on the shell side of the heat exchangers for best heat transfer.

Furthermore, the high crude oil pressure can create a severe problem if a leak develops in the heat exchanger. Since the crude oil is at the higher pressure it will leak into the hot stream with which it is being exchanged. This will contaminate the hot stream with raw crude oil. If the hot stream is a hot oil circulating stream, the leakage will return contaminated hot oil to the crude column or vacuum column, and this contaminated hot oil stream will contaminate other product streams which are withdrawn from the column(s) at loci below the locus of the hot oil return. If the hot stream is a product stream, the leakage may cause operating problems at processing units elsewhere in the refinery where that product stream is being used as a feed stock, or if the product stream is passing to storage it will contaminate the product storage. In many instances, leakage into a product stream will necessitate shutting down the crude and vacuum columns in order to repair the leak. Shutting down the crude and vacuum columns may in turn cause the entire refinery to shut down.

Another disadvantage of the conventional crude oil heat exchanger train is that the entire system must be designed to withstand the highest vapor pressure which can be anticipated. The composition of the crude oil being fed to the crude unit will not be constant. The amount of light hydrocarbon contained in the crude unit feed will vary with the source of the crude oil. Thus the vapor pressure within the heat exchanger train, the desalter, and the crude column heater will vary as the amount of light hydrocarbon varies. Because of the uncertainties of crude oil composition, the heat exchange system must be overdesigned to be safe. For example, the desalter unit is normally designed to hold 150 psig. although the vapor pressure of the crude being desalted may be below 100 psig. for ninety percent of its on-stream time.

SUMMARY OF THE INVENTION

With this then being the state of the art, the present invention was conceived in order to provide a more effective process for separating a hydrocarbon crude oil into its hydrocarbon fractions by means of an improved system for preheating the crude oil.

It is an object of the present invention to provide a more economical heat exchanger design by allowing the crude side to be established by consideration of heat transfer and distribution effectiveness, particularly for mixed phase vapor and liquid, rather than the fact that fewer pounds of steel are required when routing the crude oil through the heat exchanger tubes.

It is also an object of the present invention to provide a crude oil heat exchange system which effects an increase in the heat recovery for the crude unit.

It is another object of the present invention to provide a crude oil heat exchange system which maintains the pressure on the crude side of the exchange train lower than the pressure on the product side, to allow for more convenient shutdown of the unit for repair or replacement of leaking heat exchanger bundles.

It is an additional object of the present invention to reduce the crude side pressure drop through the crude oil heat exchanger system and thereby reduce the horsepower requirement for the crude oil pump.

It is a further object of the present invention to reduce the design pressure on the crude exchange train and the desalting unit.

It is a still further object of the present invention to eliminate the effect of uncertainties and variations in the light ends composition of the crude oil upon the operating pressure of the desalter unit.

These and other objectives, as well as the advantages of the present invention, will become more readily apparent to those skilled in the art as the summary of the invention is more fully set forth hereinafter.

In the present invention, these objectives are achieved in a crude unit which comprises a crude column and a vacuum column in combination with parallel heat exchanger banks and single or double stage flashing of the hot crude oil feed stock.

In one embodiment, the present invention comprises a process for the separation of a hydrocarbon crude oil into a plurality of product fractions which includes the steps of passing a hydrocarbon crude oil containing water soluble contaminants into a first heat exchange zone at a first elevated pressure and a first temperature; heating the crude oil within the heat exchange zone to a second temperature above the first temperature; passing heated crude oil into a first flash zone maintained under conditions sufficient to separate the heated crude oil into a first flash vapor and a first flash liquid, said conditions including a second elevated pressure below the first elevated pressure; contacting the first flash vapor with water under conditions sufficient to remove water soluble contaminants therefrom; passing the first flash liquid and said water containing water soluble contaminants, into a contacting zone maintained under conditions sufficient to remove water soluble contaminants from the first flash liquid; and, passing at least a portion of first flash liquid having substantial freedom from water soluble contaminants, into a crude oil fractionation zone.

In another embodiment, the present invention comprises a process for the separation of a hydrocarbon crude oil into a plurality of product fractions which includes the steps of passing a hydrocarbon crude oil containing water soluble contaminants into a first heat exchange zone at a first elevated pressure and a first temperature; heating the crude oil within the heat exchange zone to a second temperature above the first temperature; passing heated crude oil into a first flash zone maintained under conditions sufficient to separate the heated crude oil into a first flash vapor and a first flash liquid, said conditions including a second elevated pressure below the first elevated pressure; contacting the first flash vapor with water under conditions sufficient to remove water soluble contaminants therefrom; passing the first flash liquid and said water containing water soluble contaminants, into a contacting zone maintained under conditions sufficient to remove water soluble contaminants from the first flash liquid; passing first flash liquid having substantial freedom from water soluble contaminants into a second heat exchange zone maintained at a third elevated pressure and maintained under conditions sufficient to heat first flash liquid to a third temperature above said first temperature; passing heated first flash liquid into a second flash zone maintained under separation conditions sufficient to separate first flash liquid into a second flash vapor and a second flash liquid, said separation conditions including a fourth elevated pressure below the third elevated pressure; and passing second flash liquid into a crude oil fractionation zone.

The present invention may be more clearly understood by now referring to the accompanying drawings.

FIG. 1 sets forth a simplified schematic flow diagram for the process of the present invention wherein the crude unit comprises a crude column and a vacuum column in combination with a crude oil desalter, two circulating hot oil heat exchange zones, and two crude oil flash chambers.

Figure 2:
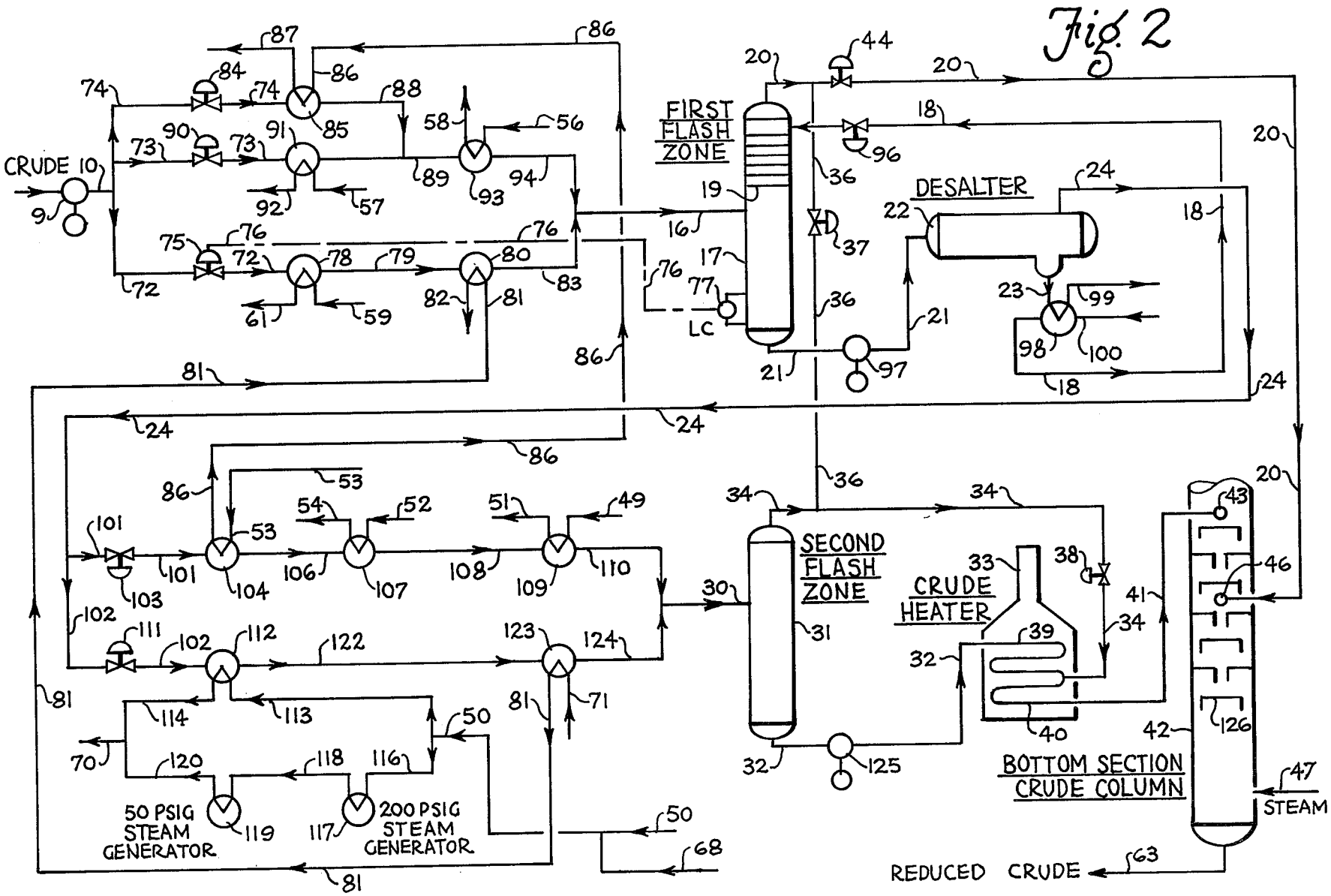

FIG. 2 sets forth a simplified schematic flow diagram for the process of the present invention showing the two heat exchange zones in specific detail and showing only the bottom section of the crude column.

DESCRIPTION OF FIG. 1

Referring to FIG. 1 for a full explanation of the process of the present invention, raw crude oil is pumped into the crude unit via line 10 and it is passed into a first heat exchange zone 11. Heat exchange zone 11 comprises a plurality of heat exchangers, not shown, which are basically in a parallel configuration. The crude oil picks up heat by exchange with a plurality of hot oil circulating streams which pass through the heat exchange zone 11 via lines 12, 13, and 14. The three circulating hot oil lines 12, 13, and 14 are merely illustrative since the number of hot oil exchangers will depend upon the crude oil composition and upon other design criteria. The hot oil circulating streams are generated in the crude column 42 and the vacuum column 64 in a conventional manner, as will be more fully discussed hereinafter.

The hot crude oil leaves heat exchange zone 11 via line 16 and passes into a first flash zone 17. Light hydrocarbon components of the hot crude oil are vaporized because of the high temperature of the crude oil, and these vapors which comprise primarily pentane and lighter components are separated from the hot liquid components within the first flash zone. Water is passed into the top of first flash zone 17 via line 18 in order to water wash the first flash vapor. The upflowing first flash vapor is contacted with downflowing liquid water on a plurality of conventional contacting trays 19 which are located in the upper section of the first flash zone. The water removes water soluble contaminants such as entrained salt from the upflowing vapor. The first flash vapor, having substantial freedom from water soluble contaminants, then leaves the top of first flash zone 17 via line 20, and it is processed in a manner which will be discussed hereinafter.

The downflowing water leaves the plurality of contacting trays 19 and drops to the bottom of first flash zone 17 with the flashed crude liquid. A mixture of water and the hot flashed crude leaves the bottom of the first flash zone and is passed via line 21 into a desalter 22. Desalter 22 is of conventional configuration and it is operated under conditions sufficient to provide that the water will remove inorganic salts from the hot flashed crude liquid. The inorganic salts are removed in order to assure that these salts will not be present further downstream where they can cause the plugging of heat exchangers, corrosion of apparatus, and other problems. The desalter also removes arsenic and other trace metals which act as poisons to catalysts which are subsequently used when further processing certain selected product fractions of the crude oil.

Water containing salt, arsenic and other metal contaminants is withdrawn from the desalter 22 via line 23 and sent to disposal, not shown, while the hot flashed crude which is substantially free of contaminants is withdrawn via line 24 and passed into a second heat exchange zone 26. Heat exchange zone 26 comprises a plurality of heat exchangers, not shown, which are primarily in a parallel configuration. The hot flashed crude picks up additional heat by exchange with a plurality of hot oil circulating streams which pass through the heat exchange zone via lines 27, 28, and 29. The three hot oil lines 27, 28 and 29 are merely illustrative since the number of hot oil exchangers will depend upon the crude oil composition and upon other design criteria. The hot oil circulating streams are generated in the crude column 42 and the vacuum column 64 in a conventional manner, as will be more fully discussed hereinafter.

The heated crude oil liquid leaves heat exchange zone 26 via line 30 and enters a second flash zone 31. At this point the temperature of the crude oil liquid is so high that a substantial amount of hexane and heavier components ($C_6$+) are vaporized. The second flash liquid leaves the bottom of second flash zone 31 via line 32 and is passed into the crude column heater 33. The crude column heater is of conventional configuration and it utilizes the combustion of gas or oil to transfer heat into a first tube bank 39 and a second tube bank 40 by means of radiation and convection.

Second flash vapor is withdrawn from second flash zone 31 via line 34. At this point it is to be noted that line 34 and line 20 are connected by means of line 36 which contains a valve 37. Valve 37 is maintained in a closed position, and the utility of line 36 and valve 37 will be discussed hereinafter. Line 34 contains a control valve 38 which is maintained in the fully open position. Second flash vapor passes through valve 38 and into crude column heater 33 via line 34.

As the second flash liquid enters the crude column heater via line 32, it is first heated in the first heater bank 39. At this point a substantial amount of vaporization occurs. However, the second flash vapor enters the crude column heater and joins the second flash liquid in the second heater bank 40. The presence of the second flash vapor, which comprises lower boiling constituents of the crude oil, promotes vaporization of the heavier hydrocarbon constituents. The second flash vapor is passed into the second heater bank 40 in order to allow the refiner to obtain the same degree of vaporization of the liquid at a lower temperature than would otherwise be obtained without the vapor injection. This reduces the tendency of the crude oil to crack in the crude column heater. Cracking of the crude oil must be avoided since it causes deposition of carbon and tarry residues in the heater tubes, and this deposition eventually can cause the crude unit to be shut down due to plugging of the heater tubes. Moreover, cracking of the crude oil must be avoided since cracking of the crude oil may adversely affect the quality of the products which are ultimately produced therefrom.

A mixture of crude oil liquid and vapor is withdrawn from the crude column heater 33 via line 41 and it is passed into the crude column 42 via feed nozzle 43. Crude column 42 is of conventional configuration, and it is shown in FIG. 1 in a highly simplified manner since those skilled in the art are aware of the various auxiliary appertenances which are a part of a conventional crude column. First flash vapor from the first flash zone 17 is passed via line 20 and through a control valve 44, which is maintained in the open position, into the crude column by means of a vapor feed nozzle 46. Vapor feed nozzle 46 is preferably located below the liquid feed nozzle 43, as shown, so that the the first flash vapor can assist in stripping downflowing liquid as the vapor flows upward. In addition, the bottom of the crude column is provided with conventional stripping stream which enters the column via line 47.

The crude column 42 is operated in the conventional manner to produce a variety of hydrocarbon product fractions. Atmospheric gas oil is removed from the column as a liquid via line 49. One portion of the atmospheric gas oil is withdrawn from line 49 via line 50 as an atmospheric gas oil product. A second portion is passed via line 49 to first heat exchange zone 11 and/or second heat exchange zone 26 as a circulating atmospheric gas oil stream. After the circulating atmospheric gas oil is cooled by heating the incoming crude oil in the first heat exchange zone 11 and/or the second heat exchange zone 26, it is returned to the crude column via line 51 to provide a refluxing liquid for the lower section of the crude column.

Diesel oil is removed from the column as a liquid via line 52. One portion of the diesel oil is withdrawn from line 52 via line 53 as a diesel oil product. A second portion is passed via line 52 to first heat exchange zone 11 and/or second heat exchange zone 26 as a circulating diesel oil stream. After the circulating diesel oil is cooled by heating the incoming crude oil in the first heat exchange zone 11 and/or the second heat exchange zone 26, it is returned to the crude column via line 54 to provide a refluxing liquid for the lower central section of the crude column.

Kerosene is next removed from the crude column 42 via line 56 as a liquid stream. One portion of the kerosene is withdrawn from line 56 via line 57 as a kerosene product. A second portion is passed via line 56 to first heat exchange zone 11. After the circulating kerosene is cooled by heating the incoming crude oil in the first heat exchange zone, it is returned to the crude column via line 58 to provide a refluxing liquid for the upper central section of the crude column.

A naphtha fraction is next removed from the column as a liquid via line 59. One portion of the naphtha is withdrawn from line 59 via line 60 as a naphtha product. A second portion is passed via line 59 to first heat exchange zone 11. After the circulating naphtha is cooled by heating the incoming crude oil in the first heat exchange zone, it is returned to the crude column via line 61 to provide a refluxing liquid for the upper section of the crude column.

An overhead vapor product is withdrawn from the top of crude column 42 via line 62. This product comprises an unstabilized gasoline fraction containing light hydrocarbon gases such as methane, ethane, propane and butane. The overhead vapor is condensed by means not shown, and the gasoline liquid is normally fractionated in a stabilizer column, not shown, before it is used as a gasoline blending component. A reduced crude fraction comprising the highest boiling components of the crude oil is withdrawn from the bottom of the crude column and passed via line 63 into a vacuum column 64.

Vacuum Column 64 is of conventional configuration, and it is shown in FIG. 1 in a highly simplified manner since those skilled in the art are aware of the various auxiliary appertenances which are a part of a conventional vacuum column. Vacuum Column 64 is maintained at a reduced pressure by means of vacuum jets, not shown, which impose a vacuum on the column by means of line 66. A light vacuum gas oil product is withdrawn from the column as a liquid via line 67. A heavy vacuum gas oil is withdrawn as a liquid via line 68, and a portion of this stream is withdrawn from line 68 via line 69 as a heavy vacuum gas oil product. A second portion of the heavy vacuum gas oil is passed via line 68 to the first heat exchange zone 11 and/or the second heat exchange zone 26 as a circulating heavy vacuum gas oil. After the circulating heavy vacuum gas oil has been cooled by heating the income crude oil feed, it is returned to the vacuum column via line 70. The heaviest hydrocarbon components of the crude oil feedstock are removed from the bottom of the vacuum column as an asphalt product via line 71.

The foregoing description sets forth one embodiment of the present invention. In this first embodiment all of the first flash vapor is passed into the lower section of the crude column 42 via line 20, valve 44, and feed nozzle 46, while all of the second flash vapor is passed into the second heater tube bank 40 of the crude heater 33 via line 34 and valve 38. In this embodiment both valves 38 and 44 are maintained in the open position while valve 37 in line 36 in maintained in the fully closed position.

In a second embodiment, all of the first flash vapor is passed into the bottom of the crude column via line 20, valve 44 and nozzle 46, with control valve 44 being open. The second flash vapor is split into two portions. A first portion is passed into the crude column heater tube bank 40 via line 34 and valve 38, while a second portion is passed via line 36 and through valve 37 into line 20, and thereby into the bottom of the crude column in admixture with the first flash vapor. In this embodiment valve 37 is fully open and valve 38 is throttled.

In a third embodiment, all of the second flash vapor passes into the crude column heater via line 34 and valve 38, with control valve 38 being open. The first flash vapor is split into two portions. A first portion passes into the crude column via line 20, valve 44, and feed nozzle 46, while a second portion is passed via line 36, valve 37, line 34, and valve 38 into the crude column heater tube bank 40 in admixture with the second flash vapor. In this embodiment valve 37 is fully open and control valve 44 is throttled to control the split between the two portions of the first flash vapor.

The choice as to which of these three embodiments is to be used will depend upon the composition of the crude oil feedstock which is being processed in the inventive crude unit. Since crude oil quality is not constant from a given source and since it is often necessary for a refinery to process crude oil from varying sources, the process of the present invention affords maximum flexibility in the operation of the crude unit since the three embodiments hereinabove described can handle any fluctuations in crude composition.

A more clear understanding of the process of the present invention may now be obtained by considering a specific example in reference to FIG. 2.

EXAMPLE AND FIG. 2

The process of the present invention was utilized in the design of a crude unit for the fractionation of about 100,000 Barrels per stream day (BPSD) of a Light Arabian Crude Oil. Light Arabian is a moderately high gravity, medium paraffinic crude oil. It is an all purpose stock which readily lends itself to the production of gasolines, distillate fuels, wax, lubricating oils, and asphalts. The crude is stabilized for the removal of free hydrogen sulfide before shipment from the Middle East, but it contains about 3 pounds of salt per 1,000 barrels of crude when received at the refinery. A typical inspection of this crude oil is given in Table 1.

FIG. 2 sets forth a simplified schematic flow diagram of the process utilized in fractionating this stock. The flow is essentially identical with that shown in FIG. 1, except that the heat exchange zones 11 and 26 of FIG. 1 are shown in specific detail in FIG. 2. For the sake of simplicity, however, only the bottom section of crude column 42 is shown in FIG. 2. The upper section of crude column 42 and the vacuum column 64 are not shown in FIG. 2, but it is to be understood by those skilled in the art that they are a part of the process of FIG. 2 since circulating hot oil streams and product streams from these two columns provide sources of heat input at the heat exchangers in the heat exchange zones.

TABLE 1

| LIGHT ARABIAN CRUDE OIL TYPICAL INSPECTION | |
|---|---|
| Gravity, ° API | 34.5 |
| , Specific | 0.8524 |
| Hydrogen Sulfide, ppm | 2 |
| Wax, Holde, Wt.% | 2.8 |
| Pour Point, ° F | −15 |
| , ° C | −26 |
| Viscosity at 70° F (21° C) | 8.9 (55 SUS) |
| 100° F (38° C) | 5.5 (44 SUS) |
| Salt, Lb./1000 Bbl. | 3 |
| Light Hydrocarbons, Vol. % | |
| Propane | 0.17 |
| Isobutane | 0.17 |
| Normal Butane | 1.06 |
| Cyclopentane | 0.07 |
| Isopentane | 0.73 |
| Normal Pentane | 1.47 |
| 2-Methylpentane | 0.62 |
| 3-Methylpentane | 0.42 |
| 2,2-Dimethylbutane | 0.01 |
| 2,3-Dimethylbutane | 0.06 |
| Normal Hexane | 1.44 |
| Methylcyclopentane | 0.22 |
| Cyclohexane | 0.16 |
| Benzene | 0.07 |
| $C_7$+ | 93.33 |

Referring now to FIG. 2, the crude oil feed stock is pumped at 60° F. by means of a pump 9 into the process of the present invention via line 10 at the rate of 101,420 BPSD or 6,051.15 moles/hr. The crude oil feed stock in line 10 is split into three portions which enter the first heat exchange zone at 60 psig. by means of lines 72, 73 and 74.

The first portion of crude oil passes through a flow control valve 75 in line 72. Flow control valve 75 is responsive to a level control signal transmitted via line 76 from a level control instrument 77 located at the bottom of the tower of first flash zone 17. The crude oil in line 72 enters a heat exchanger 78 wherein it is heated by hot circulating naphtha which is circulating from and to the crude oil column 42 as previously shown in FIG. 1. The naphtha enters heat exchanger 78 via line 59 at a temperature of 305° F. and a pressure of 105 psig. The circulating naphtha transfers 44 million BTU/hr. to the crude oil stock and leaves the heat exchanger 78 via line 61 at a temperature of 200° F. and a pressure of 100 psig. for return to the crude oil column.

The first portion of hot crude oil leaves heat exchanger 78 via line 79 at 200° F. and enters heat exchanger 80 wherein it is further heated by an Asphalt Product Stream. The Asphalt Product Stream enters heat exchanger 80 via line 81 at a temperature of 520° F. and a pressure of 70 psig. The Asphalt Product transfers 27 million BTU/hr. to the first crude oil portion which is passing through heat exchanger 80. The asphalt product thereupon leaves heat exchanger 80 at 300° F. and 65 psig. and is sent via line 82 to product storage. The first crude oil portion leaves heat exchanger 80 via line 83 at a temperature of 265° F.

The second portion of crude oil passes through a flow control valve 84 in line 74 and enters a heat exchanger 85 wherein it is heated by the diesel oil product which is produced at the crude column 42. Diesel oil product enters heat exchanger 85 via line 86 at a temperature of 350° F. and a pressure of 70 psig. The diesel product transfers about 21 million BTU/hr. to the crude oil portion and leaves heat exchanger 85 via line 87 at a temperature of 220° F. and a pressure of 65 psig. The diesel product is sent to storage after further cooling, not shown. The second crude oil portion leaves heat exchanger 85 via line 88 at a temperature of 165° F. and it joins the third portion of the crude oil in line 89 for further heating to be described hereinafter.

The third portion of crude oil feed stock passes through a flow control valve 90 in line 73 and enters a heat exchanger 91 wherein it is heated by the kerosene product which is produced by the crude column 42. Kerosene product leaves crude column 42 via line 57 as previously shown in FIG. 1, and it enters heat exchanger 91 via line 57 at a temperature of 390° F. and a pressure of 70 psig. The kerosene product transfers about 8 million BTU/hr. to the third crude oil portion and leaves heat exchanger 91 via line 92 at a temperature of 200° F. and a pressure of 65 psig. The kerosene product thereupon is sent to further cooling, not shown, and to storage, not shown. The third portion of crude oil leaves heat exchanger 91 via line 89 at 165° F. and it combines with the second portion of the crude oil entering line 89 from line 88.

The combined second and third portions of crude oil feed stock pass into heat exchanger 93 via line 89 at a temperature of 165° F., wherein they are further heated by the circulating kerosene stream which is produced by the crude column 42. Circulating kerosene leaves crude column 42 via line 56 as previously shown in FIG. 1, and enters heat exchanger 93 via line 56 at a temperature of 400° F. and a pressure of 90 psig. The circulating kerosene transfers about 35 million BTU/hr. into the second and third portions of crude oil. The circulating kerosene stream leaves heat exchanger 93 via line 58 and is thereupon returned to the crude column at a temperature of 285° F. and a pressure of 85 psig.

The combined second and third portions of crude oil now leave the heat exchanger 93 via line 94 at 265° F. and they are joined by the first portion of crude oil flowing via line 83 as they combine and enter line 16. Line 16 feeds the total crude oil feed of 6,051.15 moles/hr. into the first flash zone 17 at a temperature of 265° F. and a pressure of 45 psig. A portion of the crude oil feed stock is vaporized in first flash zone 17, thereby causing the temperature of the crude oil constituents to drop from 265° F. to 250° F. in the flash zone.

The vapor in the first flash zone is contacted with downflowing water which enters first flash zone 17 via line 18, at a temperature of 155° F. and at the rate of 4,385.55 moles/hr., from a source to be disclosed hereinafter. The downflowing water contacts the upflowing first flash vapor at the top of first flash zone 17 in a mass transfer zone which comprises a plurality of conventional vapor-liquid contacting trays 19. The downflowing water scrubs the upflowing first flash vapor of any entrained salt or other water soluble contaminants which may be contained in the vapor. The first flash vapor leaves the top of first flash zone 17 via line 20 at a temperature of 245° F. and passes through control valve 44 which is in the open position. The first flash vapor flows in line 20 at the rate of 672.22 moles/hr. and it comprises 336.11 moles/hr. of water vapor. Valve 37 in line 36 is maintained in the fully closed position so that no flow of first flash vapor occurs in line 36 and all first flash vapor flows in line 20. The first flash vapor is passed into the bottom section of the crude column 42 via line 20 and feed nozzle 46.

The first flash liquid hydrocarbon mixes with downflowing wash water at the bottom of the first flash zone 17. The mixture leaves the first flash zone via line 21 at a temperature of about 250° F. and a pressure of 45 psig. The combined liquid stream leaves the flash zone at the rate of 9,764.40 moles/hr. and it comprises 5,715.04 moles/hr. of hydrocarbon and 4,049.44 moles/hr. of water. This water and hydrocarbon mixture is pumped by means of a pump 97 into desalter 22 via line 21. Desalter 22 is maintained at 70 psig. and 245° F. The majority of water in the mixture entering the desalter separates out and leaves the bottom of desalter 22 via line 23 at 245° F. This stream comprises 3,935.14 moles/hr. of water plus the salt which has been removed from the hydrocarbon. This hot water stream enters heat exchanger 98 wherein it transfers heat to incoming cold wash water. The cooled water containing the contaminating salt leaves heat exchanger 98 after transferring about 11 million BTU/hr. of heat to the cold side and it is discharged via line 99 at 160° F. This hot water containing the contaminating salt is thereafter sent to disposal, not shown.

Fresh makeup water enters the system via line 100 at a rate of 4,385.55 moles/hr. and a temperature of 60° F. The water enters heat exchanger 98 where it picks up about 11 million BTU/hr. It leaves heat exchanger 98 via line 18 at a temperature of 155° F. and it is thereupon passed into the top of first flash zone 17 by means of a flow control valve 96 located in line 18. The water then contacts the upflowing first flash vapor in first flash zone 17 in the manner hereinbefore described.

Returning now to the desalter unit 22, the hydrocarbon liquid phase is withdrawn therefrom via line 24 at a temperature of 245° F. This liquid stream amounts to 5,829.34 moles/hr. and it comprises 114.30 moles/hr. of water and 5,715.04 moles/hr. of hydrocarbon. The hot liquid passes via line 24 into a second heat exchange zone wherein the stream is split into two portions which pass into the heat exchange zone via lines 101 and 102.

The portion of hydrocarbon and water in line 101 passes through a flow control valve 103 at about 245° F. and 65 psig. and enters a heat exchanger 104 wherein it picks up additional heat from the diesel product which is produced at the crude column 42. Diesel product leaves column 42 as shown previously in FIG. 1 and enters the heat exchanger 104 via line 53 at a temperature of 515° F. and a pressure of 75 psig. The diesel product passes about 31 million BTU/hr. to the hot hydrocarbon and water mixture in heat exchanger 104. The diesel product is withdrawn from heat exchanger 104 via line 86 at a temperature of 350° F. and a pressure of 70 psig. The diesel product stream in line 86 is thereupon passed into heat exchanger 85 as previously described hereinabove.

The water and oil mixture which has thus been further heated leaves heat exchanger 104 via line 106 at a temperature of 325° F. and enters a heat exchanger 107 wherein it is contacted with hot circulating diesel oil. The diesel oil is withdrawn from crude column 42 via line 52, as previously shown in FIG. 1, and enters the heat exchanger 107 via line 52 at a temperature of 525° F. and a pressure of 80 psig. The circulating diesel oil transfers about 54 million BTU/hr. to the water and hydrocarbon mixture in heat exchanger 107. It thereafter leaves heat exchanger 107 via line 54 at a temperature of 425° F. and a pressure of 75 psig. and is returned to the crude column as previously shown in FIG. 1.

The oil and water mixture leaves heat exchanger 107 via line 108 at a temperature of 420° F. and it enters heat exchanger 109 wherein it is heated further by circulating atmospheric gas oil. The circulating atmospheric gas oil is withdrawn from column 42 via line 49, as previously shown in FIG. 1, at a temperature of 600° F. and a pressure of 70 psig. It transfers 44 million BTU/hr. to the oil and water mixture and it is then withdrawn from heat exchanger 109 via line 51 at a temperature of 510° F. and a pressure of 65 psig. The circulating atmospheric gas oil is thereupon returned to crude column 42. The hot mixture of oil and water leaves heat exchanger 109 via line 110 at a temperature of 510° F. and a pressure of 55 psig.

The second portion of water and oil from line 24, which is in line 102, passes through a flow control valve 111 at 245° F. and 65 psig. and enters a heat exchanger 112 wherein it is heated by heat exchange with a mixture of circulating heavy vacuum gas oil and atmospheric gas oil product. Atmospheric gas oil product is withdrawn from the crude column 42 by means of line 50 and circulating heavy vacuum gas oil is withdrawn from the vacuum column via line 68. The heavy vacuum gas oil is passed into line 50 via line 68 to produce a gas oil mixture having a temperature of 540° F. One portion of the gas oil mixture is passed from line 50 into heat exchanger 112 via line 113 at a temperature of 540° F. and a pressure of 75 psig. This portion of the gas oil mixture transfers approximately 60 million BTU/hr. to the water and hydrocarbon mixture which is being heated in heat exchanger 112. The gas oil mixture leaves the heat exchanger 112 via line 114 at a temperature of 350° F. and a pressure of 65 psig.

A second portion of the gas oil mixture passes at 540° F. from line 50 into a steam generator 117 via line 116, wherein it generates steam at a pressure of 200 psig. The gas oil mixture transfers about 39 million BTU/hr. into the steam generator 117 and is then withdrawn via line 118 at 440° F. and 70 psig. for passage into a heat exchanger 119. The gas oil mixture generates steam at 50 psig. in heat exchanger 119 by transferring about 32 million BTU/hr. into this steam generator. The gas oil mixture leaves the steam generator 119 via line 120 at 350° F. and 65 psig. The portions of gas oil mixture in lines 114 and 120 then combine in line 70 and the gas oil mixture is thereby returned to the vacuum column via line 70 as previously shown in FIG. 1.

Returning now to heat exchanger 112, the heated oil and water mixture leaves heat exchanger 112 via line 122 at a temperature of 440° F. and a pressure of 60 psig. This stream enters a heat exchanger 123 wherein it is further heated by the asphalt product produced at the vacuum column 64. The asphalt product enters heat exchanger 123 via line 71 at 730° F. and 75 psig. The asphalt product transfers about 31 million BTU/hr. into the water and oil mixture and thereafter leaves heat exchanger 123 via line 81 at 520° F. and 70 psig. The asphalt product then passes via line 81 into the heat exchanger 80 as previously described hereinabove. The hot mixture of water and oil leaves heat exchanger 123 via line 124 at 510° F. and 55 psig.

The portion of hot water and oil mixture in line 124 combines with the portion of hot water and oil mixture in line 110 and the two combined streams then pass into the second flash zone 31 via line 30 at the rate of 5,829.34 moles/hr. and at a temperature of 510° F. This stream comprises 5,715.04 moles/hr. of hydrocarbon and 114.30 moles/hr. of water. The incoming water and oil mixture is vaporized at 45 psig. in second flash zone 31, thereby causing the temperature to drop to 500° F.

A substantial portion of the material entering second flash zone 31 flashes into the vapor state and is withdrawn from the top of the zone via line 34, while the liquid remaining is withdrawn from the bottom of the zone via line 32. The liquid is withdrawn at a rate of 3,511.01 moles/hr. and at a temperature of 500° F. This liquid stream comprises 3,506.09 moles/hr. of hydrocarbon and 4.92 moles/hr. of water. It is pumped to a pressure of 170 psig. by means of pump 125 and it is then passed via line 32 into the crude heater 33. Crude heater 33 is a conventional heater wherein the flashed liquid picks up additional heat by the radiation and convection which arises in the heater by means of the combustion of oil or gas. The flashed liquid is first heated in a heater tube bank 39 and then in a heater tube bank 40 within crude heater 33.

Returning now to the second flash vapor, it is withdrawn from the top of second flash zone 31 via line 34 at a rate of 2,318.33 moles/hr. and a temperature of 500° F. The second flash vapor comprises 2,208.95 moles/hr. of hydrocarbon and 109.38 moles/hr. of water. There is no flow of second flash vapor in line 36, since valve 37 is maintained in the fully closed position. All of the second flash vapor is passed through control valve 38 which is maintained open and enters the crude heater 33 via line 34 at the second heater tube bank 40. The resulting mixture of second flash liquid and second flash vapor is further heated in tube bank 40 as previously described hereinabove in reference to FIG. 1. The total amount of heat added to the components of the vapor and liquid phases at crude heater 33 is about 211 million BTU/hr.

A mixture of vapor and liquid is withdrawn from crude heater 33 via line 41 at the rate of 5,829.34 moles/hr. and a temperature of 715° F. This stream contains 5,715.04 moles/hr. of hydrocarbon and 114.30 moles/hr. of water. The hot vapor and liquid stream of line 41 enters the crude column 42 via feed nozzle 43 wherein it is contacted by upflowing vapor and downflowing liquids at a temperature of 685° F. and a pressure of 15 psig.

It is to be noted that the feed inlet 43 is located about the feed inlet 46 of the first flash vapor. Downflowing liquid is thereby stripped by upflowing first flash vapor as well as by stripping steam which enters the bottom of crude column 42 via line 47. The bottom section of the crude column contains a plurality of vapor-liquid contacting trays 126 which are of conventional design. The upflowing first flash vapor and the upflowing stripping steam remove lower boiling constituents from the downflowing liquid in order to produce a reduced crude which is withdrawn from the bottom of column 42 via line 63. The reduced crude is passed via line 63 to the vacuum column 64 which is not shown in FIG. 2, while upflowing vapor leaves the bottom section of the crude column 42 to produce the various hot oil circulating streams and product streams of this example in a manner similar to that shown previously in FIG. 1.

The component distribution for the first flash zone and the second flash zone in given in Table 2, while the product distribution for this example is given in Table 3. Note that there is no atmospheric gas oil product shown in Table 3 since there is no atmospheric gas oil product produced in this example. The atmospheric gas oil product withdrawn from crude column 42 via line 50 was mixed with the circulating heavy vacuum gas oil which was withdrawn from the vacuum column 64 via line 68. The resulting gas oil mixture provided heat input at heat exchangers 112, 117, and 119 and it was then passed to the vacuum column 64 via line 70. Thus the components of atmospheric gas oil product leave the process of this example as a portion of the light vacuum gas oil which is produced. Also note that there is no gasoline product shown in Table 3. In this example all components in the gasoline and naphtha boiling range are taken off of the crude column as an overhead vapor product via line 62. No product is withdrawn from the column via line 60 as shown in FIG. 1. When the vapor is condensed in the conventional manner, the gas product and the unstabilized naphtha product are produced.

TABLE 3-continued

| | PRODUCT DISTRIBUTION | | | | | |
|---|---|---|---|---|---|---|
| | ° API | K | Mole Wt. | BPSD | Lb./Hr. | Moles/ Hr. |
| Diesel Oil | 37.9 | 11.91 | 216 | 22,520 | 274,420 | 1267.65 |
| Light Vacuum Gas Oil | 29.4 | 11.90 | 305 | 9,430 | 121,020 | 396.31 |
| Heavy Vacuum Gas Oil | 20.0 | 11.91 | 425 | 19,890 | 271,060 | 637.68 |
| Asphalt | 8.0 | 11.38 | 588 | 15,000 | 222,020 | 377.32 |

PREFERRED EMBODIMENT

From the foregoing description it will be readily seen that many advantages are derived from the process of the present invention.

For example, since the pressure on the crude oil side of the heat exchangers is maintained lower than the pressure on the hot oil side of the exchangers, any leaking heat exchanger will leak a refined hot oil stream into the unrefined crude oil. Thus there is no contamination of any refined hot oil stream. This allows the crude unit to continue on stream regardless of a leaking heat exchanger, and shutdown of the unit for repair or replacement of the leaking exchanger bundle may be scheduled for a more convenient time.

Additionally, the process of the present invention eliminates the effect of uncertainties and variations in the light ends composition of the crude oil on the operating pressure of the desalter. By setting the operating pressure of the first flash zone, the vapor pressure of the first flash liquid is established. This means that the vapor pressure of the liquid entering the desalter remains constant.

Moreover, the process of the present invention reduces the required design pressure on the crude heat exchanger train and on the desalter. The hot oil product and circulating streams are at the pressure generated by a conventional crude unit operation, but the pressure of the crude oil feedstock is lower than required for prior art operation. Thus equipment cost is lower since the crude oil pressure is lower. For example, the conventional crude desalter is designed to hold 150 psig. whereas the process of the present invention allows the desalter to be designed for 90 psig.

In addition, the inventive process reduces the crude side pressure drop across the heat exchangers and this in turn reduces the horsepower requirement for the crude oil feed pump. In the conventional crude unit the heat

TABLE 2

| | FLASH ZONE MATERIAL BALANCES Moles Per Hour | | | | | | |
|---|---|---|---|---|---|---|---|
| | First Flash Zone 17 | | | | Second Flash Zone 31 | | |
| | Crude Feed In Line 16 | Water Feed In Line 18 | Vapor Out Via Line 20 | Liquid Out Via Line 21 | Flashed Feed In Line 30 | Vapor Out Via Line 34 | Liquid Out Via Line 32 |
| $H_2O$ | — | 4385.55 | 336.11 | 4049.44 | 114.30 | 109.38 | 4.92 |
| $H_2S$ | 3.32 | — | 2.15 | 1.17 | 1.17 | 1.14 | 0.03 |
| $C_1$ | 5.32 | — | 4.66 | 0.66 | 0.66 | 0.65 | 0.01 |
| $C_2$ | 43.77 | — | 30.16 | 13.61 | 13.61 | 13.27 | 0.34 |
| $C_3$ | 145.75 | — | 69.82 | 75.93 | 75.93 | 72.06 | 3.87 |
| $iC_4$ | 49.48 | — | 16.69 | 32.79 | 32.79 | 30.08 | 2.71 |
| $nC_4$ | 198.03 | — | 60.45 | 137.58 | 137.58 | 124.90 | 12.68 |
| $iC_5$ | 92.24 | — | 18.41 | 73.83 | 73.83 | 63.64 | 10.19 |
| $nC_5$ | 187.62 | — | 33.76 | 153.86 | 153.86 | 131.37 | 22.49 |
| CP | 10.93 | — | 1.59 | 9.34 | 9.34 | 7.83 | 1.51 |
| $C_6$+ | 5314.69 | — | 98.42 | 5216.27 | 5216.27 | 1764.01 | 3452.26 |
| | 6051.15 | 4385.55 | 672.22 | 9764.43 | 5829.34 | 2318.33 | 3511.01 |
| LB/HR | 1,254,390 | 79,010 | 28,470 | 1,304,930 | 1,234,030 | 252,150 | 981,880 |
| BPSD | 101,420 | 5,415 | 2,925 | 103,910 | 99,055 | 23,545 | 75,510 |

TABLE 3

| | PRODUCT DISTRIBUTION | | | | | |
|---|---|---|---|---|---|---|
| | ° API | K | Mole Wt. | BPSD | Lb./Hr. | Moles/ Hr. |
| Crude Feedstock | 35.4 | 12.00 | 207 | 101,420 | 1,254,390 | 6051.15 |
| Gas | — | — | 47.6 | — | 5,760 | 121.04 |
| Un-stabilized Naphtha | 66.7 | 12.33 | 103 | 27,970 | 291,320 | 2815.76 |
| Kerosene | 46.8 | 11.93 | 158 | 5,940 | 68,790 | 435.39 |

exchangers are in series and the pressure drop is understandably high. In the inventive process parallel exchanger trains are utilized so that the pressure drop is lower.

Furthermore, the process of the present invention provides a more economical heat exchanger design by allowing the crude side to be established by heat transfer and distribution considerations rather than the fact that fewer pounds of steel are required by routing the higher pressure crude stream through the tubes. In the prior art processes the crude pressure is higher than the hot oil pressure so that the design provides for sending the crude through the exchanger tubes where the strength is greater for the amount of steel. But the cold crude should generally be put on the shell side for the best heat exchange. The process of the present invention allows this to be done since the crude side pressure is lower than the hot oil side in the inventive process.

These and other advantages will be readily understood and recognized by those skilled in the art.

In view of the foregoing discussion it may now be summarized that a preferred embodiment of the present invention comprehends a process for separation of a hydrocarbon crude oil into a plurality of product fractions which comprises passing a hydrocarbon crude oil containing water soluble contaminants into a first flash zone maintained under conditions sufficient to separate said crude oil into a first flash vapor and a first flash liquid; contacting said first flash vapor with water in a first contacting zone maintained under conditions sufficient to remove water soluble contaminants therefrom and thereby produce water containing water soluble contaminants; passing said first flash liquid and said water containing water soluble contaminants, into a second contacting zone maintained under conditions sufficient to remove water soluble contaminants from said first flash liquid; and passing at least a portion of first flash liquid having substantial freedom from water soluble contaminants, into a crude oil fractionation zone.

Further, in view of the foregoing discussion it may now be summarized that a second preferred embodiment of the present invention comprehends a process for separation of a hydrocarbon crude oil into a plurality of product fractions which comprises passing a hydrocarbon crude oil containing water soluble contaminants into a first flash zone maintained under conditions sufficient to separate said crude oil into a first flash vapor and a first flash liquid; contacting said first flash vapor with water in a first contacting zone maintained under conditions sufficient to remove water soluble contaminants therefrom and thereby produce water containing water soluble contaminants; passing said first flash liquid and said water containing water soluble contaminants, into a second contacting zone maintained under conditions sufficient to remove water soluble contaminants from said first flash liquid; passing first flash liquid having substantial freedom from water soluble contaminants into a second flash zone maintained under conditions sufficient to separate first flash liquid into a second flash vapor and a second flash liquid; and passing said second flash liquid into a crude oil fractionation zone.

In light of the foregoing disclosure, alternative modes of practicing the inventive process will undoubtedly suggest themselves to those skilled in the art. It is thus intended that the disclosure be taken as illustrative only, and that it not be construed in any limiting sense.

The invention claimed is:

1. Process for separation of a hydrocarbon crude oil into a plurality of product fractions which comprises:

(a) Passing a hydrocarbon crude oil containing water soluble contaminants into a first heat exchange zone at a first elevated pressure and a first temperature;

(b) Heating said crude oil within said heat exchange zone to a second temperature above said first temperature;

(c) Passing heated crude oil into a first flash zone maintained under conditions sufficient to separate said heated crude oil into a first flash vapor and a first flash liquid, said conditions including a second elevated pressure below said first elevated pressure;

(d) Contacting said first flash vapor with water under conditions sufficient to remove water soluble contaminants therefrom and thereby produce water containing water soluble contaminants;

(e) Passing said first flash liquid and said water containing water soluble contaminants, into a separation zone maintained under conditions sufficient to remove water soluble contaminants from said first flash liquid; and, (f) Passing at least a portion of first flash liquid having substantial freedom from water soluble contaminants, into a crude oil fractionation zone.

2. Process of claim 1 wherein first flash vapor having substantial freedom from water soluble contaminants is passed into said crude oil fractionation zone.

3. Process of claim 1 wherein first flash liquid having substantial freedom from water soluble contaminants is passed at a third elevated pressure into a second heat exchange zone maintained under conditions sufficient to heat first flash liquid to a third temperature above said first temperature, heated first flash liquid is passed into a second flash zone maintained under separation conditions sufficient to separate first flash liquid into a second flash vapor and a second flash liquid, said separation conditions including a fourth elevated pressure below said third elevated pressure, and said second flash liquid is passed into said crude oil fractionation zone.

4. Process of claim 3 wherein said second flash liquid and at least a portion of said second flash vapor are heated, and a heated mixture of second flash liquid and second flash vapor is passed into said crude oil fractionation zone at a first locus.

5. Process of claim 4 wherein said first flash vapor is passed into said crude oil fractionation zone at a second locus separated from said first locus.

6. Process of claim 4 wherein second flash liquid, second flash vapor, and at least a portion of first flash vapor are heated, and a heated mixture of second flash liquid, second flash vapor, and first flash vapor is passed into said crude oil fractionation zone at said first locus.

7. Process of claim 6 wherein a second portion of first flash vapor is passed into said crude oil fractionation zone at a second locus separated from said first locus.

8. Process of claim 4 wherein a first portion of second flash vapor is heated with said second flash liquid and a second portion of second flash vapor is passed into said crude oil fractionation zone.

9. Process of claim 8 wherein said first flash vapor and said second portion of second flash vapor are passed into said fractionation zone at a second locus separated from said first locus.

10. Process for separation of a hydrocarbon crude oil into a plurality of product fractions which comprises:

(a) Passing a hydrocarbon crude oil containing water soluble contaminants into a first flash zone maintained under conditions sufficient to separate said crude oil into first flash vapor and a first flash liquid;

(b) Contacting said first flash vapor with water in a contacting zone maintained under conditions sufficient to remove water soluble contaminants therefrom and thereby produce water containing water soluble contaminants;

(c) Passing said first flash liquid and said water containing water soluble contaminants, into a separation zone maintained under conditions sufficient to remove water soluble contaminants from said first flash liquid; and, (d) Passing at least a portion of first flash liquid having substantial freedom from water soluble contaminants, into a crude oil fractionation zone.

11. Process of claim 10 wherein first flash vapor having substantial freedom from water soluble contaminants is passed into said crude oil fractionation zone.

12. Process of claim 10 wherein first flash liquid having substantial freedom from water soluble contaminants is passed into a second flash zone maintained under conditions sufficient to separate first flash liquid into a second flash vapor and a second flash liquid, and said second flash liquid is passed into said crude oil fractionation zone.

13. Process of claim 12 wherein said second flash liquid and at least a portion of said second flash vapor are heated, and a heated mixture of second flash liquid and second flash vapor is passed into said crude oil fractionation zone at a first locus.

14. Process of claim 13 wherein said first flash vapor is passed into said crude oil fractionation zone at a second locus separated from said first locus.

15. Process of claim 13 wherein second flash liquid, second flash vapor, and at least a portion of first flash vapor are passed into said heat exchange zone.

16. Process of claim 15 wherein a second portion of first flash vapor is passed into said crude oil fractionation zone at a second locus separated from said first locus.

17. Process of claim 13 wherein a first portion of second flash vapor is passed into said heat exchange zone and a second portion of second flash vapor is passed into said crude oil fractionation zone.

18. Process of claim 17 wherein said first flash vapor and said second portion of second flash vapor are passed into said fractionation zone at a second locus separated from said first locus.

* * * * *